US009394593B2

(12) United States Patent
Kaizuka et al.

(10) Patent No.: US 9,394,593 B2
(45) Date of Patent: Jul. 19, 2016

(54) BEARING STEEL MATERIAL WITH EXCELLENT ROLLING CONTACT FATIGUE PROPERTIES AND A BEARING PART

(75) Inventors: Masaki Kaizuka, Kobe (JP); Mutsuhisa Nagahama, Kobe (JP); Masaki Shimamoto, Kobe (JP); Tomoko Sugimura, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 172 days.

(21) Appl. No.: 14/008,628

(22) PCT Filed: Mar. 5, 2012

(86) PCT No.: PCT/JP2012/055553

§ 371 (c)(1),
(2), (4) Date: Sep. 30, 2013

(87) PCT Pub. No.: WO2012/132771

PCT Pub. Date: Oct. 4, 2012

(65) Prior Publication Data

US 2014/0017112 A1 Jan. 16, 2014

(30) Foreign Application Priority Data

Mar. 31, 2011 (JP) ..... 2011-079586

(51) Int. Cl.

| | |
|---|---|
| ***C22C 29/12*** | (2006.01) |
| ***C22C 38/18*** | (2006.01) |
| ***C21D 9/40*** | (2006.01) |
| ***C22C 38/00*** | (2006.01) |
| ***C22C 38/02*** | (2006.01) |

(Continued)

(52) U.S. Cl.

CPC . *C22C 38/18* (2013.01); *C21D 9/40* (2013.01); *C22C 29/12* (2013.01); *C22C 38/002* (2013.01); *C22C 38/02* (2013.01); *C22C 38/04* (2013.01); *C22C 38/06* (2013.01)

(58) Field of Classification Search

CPC ..... C22C 29/12; C21D 2211/003

See application file for complete search history.

(56) References Cited

U.S. PATENT DOCUMENTS

2007/0051432 A1 3/2007 Kimura et al.

FOREIGN PATENT DOCUMENTS

| | | |
|---|---|---|
| CN | 1460127 A | 12/2003 |
| JP | 6 2073 | 1/1994 |
| JP | 2006-200027 A | 8/2006 |

(Continued)

OTHER PUBLICATIONS

Written Opinion of International Searching Authority Issued May 29, 2012 in PCT/JP12/055553 Filed Mar. 5, 2012.

(Continued)

*Primary Examiner* — Scott Kastler
*Assistant Examiner* — Vanessa Luk
(74) *Attorney, Agent, or Firm* — Oblon, McClelland, Maier & Neustadt, L.L.P.

(57) ABSTRACT

Bearing steel material according to the present invention has: a properly adjusted chemical composition; an average chemical composition of oxide-inclusions which comprises 10 to 45% of CaO, 20 to 45% of $Al_2O_3$, 30 to 50% of $SiO_2$, up to 15% (exclusive of 0) of MnO, and 3 to 10% of MgO, with the balance being unavoidable impurities; a maximum major axis diameter of the oxide inclusions in a longitudinal section of the steel material of 20 μm or less; and a spheroidal cementite structure.

7 Claims, 1 Drawing Sheet

(51) Int. Cl.
*C22C 38/04* (2006.01)
*C22C 38/06* (2006.01)

(56) References Cited

FOREIGN PATENT DOCUMENTS

| | | | |
|---|---|---|---|
| JP | 2007 92164 | | 4/2007 |
| JP | 2008-240019 | A | 10/2008 |
| JP | 2009 30145 | | 2/2009 |
| JP | 2009-161854 | A | 7/2009 |
| JP | 2010 7092 | | 1/2010 |

OTHER PUBLICATIONS

Extended European Search Report issued Jan. 7, 2015 in Patent Application No. 12765877.1.

BEARING STEEL MATERIAL WITH EXCELLENT ROLLING CONTACT FATIGUE PROPERTIES AND A BEARING PART

TECHNICAL FIELD

The present invention relates to bearing steel material exerting excellent rolling contact fatigue properties when used as rolling elements for bearings (roller, needle, ball, etc.) to be used in various industrial machines and automobiles, etc., and to bearing parts obtained from such the bearing steel material.

BACKGROUND ART

To the rolling elements for bearings (roller, needle, ball, etc.) used in the fields of various industrial machines and automobiles, etc., high repeated stress is applied in the radial direction. Accordingly, the rolling elements for bearings are required to have excellent rolling contact fatigue properties.

It is known that rolling contact fatigue properties are decreased when a non-metallic inclusion is present in steel. Traditionally, it has been attempted to reduce the content of oxygen in steel as much as possible by steel processes. However, the demands for rolling contact fatigue properties are becoming stricter year by year in response to the high performance and weight saving in industrial machines, etc. Bearing steel material is required to have better rolling contact fatigue properties in order to further improve the durability of bearing parts.

Until now, various techniques for improving rolling contact fatigue properties have been presented. For example, Patent Literature 1 discloses steel material that has excellent wire drawability and rolling contact fatigue properties by properly adjusting the ranges of the contents of elements, such as C, Si, Mn, and Al, and by specifying the number of oxide-inclusions in accordance with the chemical compositions thereof.

However, this technique is used to convert the structure of the steel material into fine pearlite, not into a structure in which spheroidal carbides are dispersed, and hence the rolling contact fatigue properties and wear resistance are insufficient.

Patent Literature 2 discloses bearing steel material that has: a chemical composition which comprises 0.6 to 1.2% of C, 0.1 to 0.8% of Si, 0.1 to 1.5% of Mn, up to 0.03% of P, up to 0.010% of S, 0.5 to 2.0% of Cr, up to 0.005% of Al, up to 0.0005% of Ca, and up to 0.0020% of O, with the balance being Fe and unavoidable impurities; an average chemical composition of non-metallic oxide-inclusions which comprises 10 to 60% of CaO, up to 20% of $Al_2O_3$, up to 50% of MnO, and up to 15% of MgO, with the balance being $SiO_2$ and unavoidable impurities; and the arithmetic mean value of the maximum thickness of each of oxides and sulfides, which are present in an area of 100 $mm^2$ in each of ten locations in the longitudinal direction of the longitudinal section of the steel material, are 8.5 μm or less, respectively.

According to this technique, the rolling contact fatigue properties of a member, to which a load acting in the thrust direction is applied, are improved by the inclusions extending and accordingly the thickness being reduced; however, when a load is applied in the radial direction, as in a rolling element, such as roller, needle, ball, or the like, it cannot be said that the rolling contact fatigue properties are sufficient, and it is expected that early peeling may occur.

On the other hand, Patent Literature 3 discloses bearing steel material that has: a chemical composition which comprises 0.85 to 1.2% of C, 0.1 to 0.5% of Si, 0.05 to 0.6% of Mn, P≤0.03%, S≤0.010%, 1.2 to 1.7% of Cr, Al≤0.005%, Ca≤0.0005%, and O≤0.0020%, with the balance being Fe and unavoidable impurities; an average chemical composition of non-metallic oxide-inclusions which includes 10 to 60% of CaO, $Al_2O_3$≤35%, MnO≤35%, and MgO≤15%, with the balance being $SiO_2$ and unavoidable impurities; the arithmetic mean value of the maximum thickness of each of the oxides and sulfides, which are present in an area of 100 $mm^2$ in each of ten locations in the longitudinal direction of the longitudinal section of the steel material, are 8.5 μm or less, respectively; and the average section hardness of the steel material at an R/2 position from the surface of the steel material (where "R" is the radius of the bearing steel material) is 290 or less in Vickers hardness.

Also, in this technique, the rolling contact fatigue properties of a member, to which a load acting in the thrust direction is applied, are improved by the inclusions extending and accordingly the thickness being reduced; however, when a load is applied in the radial direction, as in a rolling element, such as roller, needle, ball, or the like, it cannot be said that the rolling contact fatigue properties are sufficient, and it is expected that early peeling may occur.

CITATION LIST

Patent Literature

Patent Literature 1: Japanese Unexamined Patent Publication No. 2007-92164

Patent Literature 2: Japanese Unexamined Patent Publication No. 2009-30145

Patent Literature 3: Japanese Unexamined Patent Publication No. 2010-7092

SUMMARY OF INVENTION

Technical Problem

The present invention has been made in view of these situations, and an object of the invention is to provide bearing steel material that is more excellent in rolling contact fatigue properties than conventional technologies when used in a bearing part to which a load acting in the radial direction is repeatedly applied, such as roller, needle, ball, or the like, thereby allowing early peeling to be suppressed.

Solution to Problem

In bearing steel material with excellent rolling contact fatigue properties according to the present invention, the steel material includes 0.8 to 1.1% of C (where % means % by mass, the same shall apply hereinafter with respect to chemical compositions), 0.15 to 0.8% of Si, 0.10 to 1.0% of Mn, up to 0.05% (exclusive of 0) of P, up to 0.01% (exclusive of 0) of S, 1.3 to 1.8% of Cr, 0.0002 to 0.005% of Al, 0.0002 to 0.0010% of Ca, and up to 0.0030% (exclusive of 0) of O, with the balance being iron and unavoidable impurities; an average chemical composition of oxide-inclusions contained in the steel material is 10 to 45% of CaO, 20 to 45% of $Al_2O_3$, 30 to 50% of $SiO_2$, up to 15% (exclusive of 0) of MnO, and 3 to 10% of MgO, and the balance being unavoidable impurities; the maximum major axis diameter of the oxide-inclusions in a longitudinal section of the steel material is 20 μm or less; and the steel material has a spheroidal cementite structure.

A specific example of the bearing steel material according to the present invention includes one obtained by being subjected to cold working at a working ratio of 5% or more after spheroidizing annealing. Further, a bearing part with excellent rolling contact fatigue properties can be obtained by using such the bearing steel material.

Advantageous Effects of Invention

According to the present invention, bearing steel material, having more excellent rolling contact fatigue properties than conventional technologies, thereby allowing early peeling to be suppressed, can be achieved: by properly adjusting the chemical composition of the steel material; by controlling the composition of oxide-inclusions contained in the steel such that the inclusions themselves are made to be easily divided by being softened; and by controlling a maximum major axis diameter of oxide-inclusions in the longitudinal section so as to be a predetermined value or less. Such the bearing steel material is extremely useful as a material for bearing parts to which a load acting in the radial direction is repeatedly applied, such as roller, needle, and ball.

DESCRIPTION OF EMBODIMENTS

Figure 1:
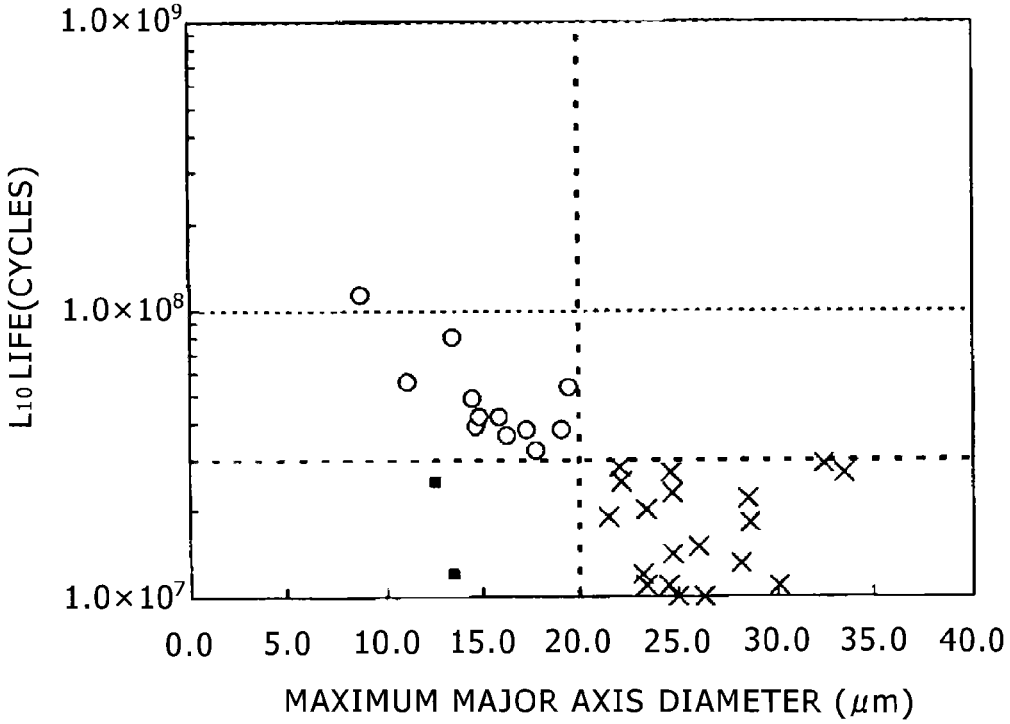
FIG. 1 is a graph showing the relationship between a maximum major axis diameter of oxide-inclusions and $L_{10}$ life.

In order to improve the rolling contact fatigue properties of a bearing part to which a load acting in the radial direction is repeatedly applied, the present inventors have studied, particularly focusing on control of inclusions. As a result, the inventors have found that the rolling contact fatigue properties are made to be extremely good: by properly adjusting the chemical composition of the steel material; by controlling the composition of oxide-inclusions with Si deoxidation such that the inclusions themselves are made to be easily divided by being softened; and by controlling a maximum major axis diameter of oxide-inclusions in the longitudinal section so as to be a predetermined value or less by subjecting the steel material to cold working at a predetermined working ratio after spheroidizing annealing, which leads to the completion of the present invention.

It is conventionally known that the rolling contact fatigue properties (rolling contact fatigue life) of bearing steel material used in a treated oil environment (where a lubricant including no foreign substance is used) are generally in a state of being likely to be peeled off with a non-metallic inclusion (in particular, an oxide-inclusion) becoming a stress concentration source that will be converted into a starting point for the above state. According to the study that the present inventors have conducted, using a radial rolling contact fatigue testing machine, with respect to the relationship between the form of an oxide-inclusion and the rolling contact fatigue property, it has been found that the rolling contact fatigue properties can be improved by softening the oxide-inclusion and by making a maximum major axis diameter of oxide-inclusions in the longitudinal section to be small. Herein, the aforementioned radial rolling contact fatigue testing machine refers to a point-contact-type rolling contact fatigue testing machine, with which rolling contact fatigue is tested by applying a load in the radial direction to a bearing part, such as roller, needle, or the like (see, e.g., "NTN TECHNICAL REVIEW" No. 71 (2003), FIG. 2).

In order to soften oxide-inclusions in bearing steel material, it is needed to adjust a chemical composition (average chemical composition) of the oxide-inclusions as follows. This chemical composition can comprise a small amount of impurities (for example, CuO, NiO, etc.), although it is assumed that the total of elements (total of CaO, $Al_2O_3$, $SiO_2$, MnO, and MgO) is 100%.

[CaO: 10 to 45%]

In an oxide whose basic chemical composition is made by $SiO_2$ that is an acidic oxide, the liquidus line temperature of the oxide is lowered by including CaO that is basic, thereby exhibiting ductility within a rolling temperature region. Such an effect can be obtained when the content of CaO is 10% or more in an average oxide chemical composition. However, if the content of CaO is too high, a coarse inclusion is generated, and hence it is needed to make the content thereof to be up to 45%. The lower limit of the content of CaO is preferably 13% or more (more preferably 15% or more) in the oxide inclusions, and the upper limit thereof is preferably up to 43% (more preferably up to 41%).

[$Al_2O_3$: 20 to 45%]

If the content of $Al_2O_3$ that is an amphoteric oxide is more than 45% in an average oxide chemical composition, an $Al_2O_3$ (corundum) phase crystallizes within a rolling temperature region, or an $MgO.Al_2O_3$ (spinel) phase crystallizes along with MgO. These solid phases are hard and difficult to be divided during rolling working and cold working and exist as coarse inclusions, and hence a void is likely to be generated during the working and rolling contact fatigue properties are deteriorated. From these viewpoints, it is needed to make the content of $Al_2O_3$ to be up to 45% in an average oxide chemical composition. On the other hand, if the content of $Al_2O_3$ is less than 20% in oxide-inclusions, deformation resistance of the inclusion is increased during hot working, and hence a fining effect cannot be obtained in the subsequent cold working. The lower limit of the content of $Al_2O_3$ is preferably 22% or more (more preferably 24% or more) in the oxide-inclusions, and the upper limit thereof is preferably up to 43% (more preferably up to 41%).

[$SiO_2$: 30 to 50%]

When 30% or more of $SiO_2$ is comprised in oxide-inclusions, the oxide-inclusion becomes soft with the melting point thereof being lowered, thereby allowing the deformation resistance of the inclusion to be reduced during hot working and cold working. And, rolling contact fatigue properties can be improved with the inclusion being divided and fined during the cold working. In order to exert such an effect, it is needed to comprise 30% or more of $SiO_2$ in oxide-inclusions. However, if the content of $SiO_2$ is more than 50%, the inclusion becomes hard with the viscosity and melting point being increased, and hence the inclusion becomes difficult to be divided during the subsequent cold working. The lower limit of the content of $SiO_2$ is preferably 32% or more (more preferably 35% or more) in the oxide-inclusions, and the upper limit thereof is up to 45% (more preferably up to 40%).

[MnO: Up to 15% (Exclusive of 0)]

MnO has basicity as an oxide and has an effect of facilitating the softening of an $SiO_2$ oxide. However, if the content of MnO is more than 15%, an $MnO.Al_2O_3$(Galaxite) phase crystallizes within a rolling temperature region. This solid phase is hard and difficult to be divided during rolling working and cold working and exists as a coarse inclusion, and hence rolling contact fatigue properties are deteriorated. Accordingly, the content of MnO is made to be up to 15% in an average oxide chemical composition. The lower limit of the content of MnO is preferably 2% or more (more preferably 5% or more) in oxide-inclusions, and the upper limit thereof is preferably up to 13% (more preferably up to 11%).

[MgO: 3 to 10%]

MgO is a basic oxide, and can soften an $SiO_2$ oxide with a small amount thereof and further has an effect of lowering the melting point of an oxide, and hence the deformation resistance of the oxide is reduced during hot working, thereby allowing the oxide to be easily fined. In order to exert such an effect, it is needed to comprise 3% or more of MgO in oxide-inclusions. On the other hand, if the content of MgO is more than 10%, an amount of crystallization of an $MgO.Al_2O_3$ (spinel) phase, along with a hard MgO phase and $Al_2O_3$, is increased, and hence the deformation resistance of an oxide is increased during hot working and cold working and the oxide becomes coarse. Accordingly, it is desirable for the improvement of rolling contact fatigue properties to comprise 3 to 10% of MgO in oxides. The lower limit of the content of MgO is preferably 3.5% or more (more preferably 4.0% or more) in oxide-inclusions, and the upper limit thereof is preferably up to 9.6% (more preferably up to 9.4%).

The bearing steel material according to the present invention has a spheroidal cementite structure by being subjected to spheroidizing annealing, and a maximum major axis diameter of oxide-inclusions in the longitudinal section is made to be 20 μm or less by being subjected to cold working at a predetermined working ratio after the spheroidizing annealing (which will be described later).

[Maximum Major Axis Diameter of Oxide-Inclusions in Longitudinal Section: 20 μm or Less]

When a bearing is repeatedly applied with a certain load in a treated oil environment, stress concentration is generated in a non-metallic inclusion, which results in peeling through occurrence and spread of a crack. If the maximum major axis diameter of oxide-inclusions is large with respect to the rolling direction, the possibility that an inclusion may be present on a rolling contact surface that receives fatigue is increased, and high stress concentration is generated, and hence early peeling is likely to be caused. In order to suppress such a phenomenon, a maximum major axis diameter of oxide-inclusions in the longitudinal section is made to be 20 μm or less. The maximum major axis diameter is preferably 18 μm or less, and more preferably 16 μm or less.

The chemical composition of the steel material according to the present invention is also required to be properly adjusted in order to satisfy basic elements as bearing steel material and to properly control the oxide-inclusion chemical composition. From these viewpoints, the reason why the range of the chemical composition of the steel material is set is as follows.

[C: 0.8 to 1.1%]

C is an essential element for providing wear resistance by increasing quenching hardness and maintaining the strength at room temperature and a high temperature. In order to exert such an effect, it is needed to comprise at least 0.8% or more of C. However, if the content of C is too high beyond 1.1%, a huge carbide is likely to be generated in the core portion of a bearing, which will adversely affects rolling contact fatigue properties. The lower limit of the content of C is preferably 0.85% or more (more preferably 0.90% or more), and the upper limit thereof is preferably up to 1.05% (more preferably up to 1.0%).

[Si: 0.15 to 0.8%]

Si effectively acts as a deoxidizing element, and also has a function of increasing hardness by increasing quenching and tempering softening resistance. In order to effectively exert such an effect, it is needed to comprise 0.15% or more of Si. However, if the content of Si is excessive beyond 0.8%, a mold life is shortened during forging, which also leads to increased cost. The lower limit of the content of Si is preferably 0.20% or more (more preferably 0.25% or more), and the upper limit thereof is preferably up to 0.7% (more preferably up to 0.6%).

[Mn: 0.10 to 1.0%]

Mn is an element that increases the solid solution strengthening of a steel matrix and hardenability. If the content of Mn is less than 0.10%, the effect is not exerted; on the other hand, if the content thereof is more than 1.0%, the content of MnO that is a lower oxide is increased, and hence rolling contact fatigue properties are deteriorated and the workability and machinability are remarkably decreased. The lower limit of the content of Mn is preferably 0.2% or more (more preferably 0.3% or more), and the upper limit thereof is up to 0.8% (more preferably up to 0.6%).

[Cr: 1.3 to 1.8%]

Cr is an element that improves hardenability and improves strength and wear resistance by forming a stable carbide, thereby allowing rolling contact fatigue properties to be effectively improved. In order to exert such an effect, it is needed to comprise 1.3% or more of Cr. However, if the content of Cr is excessive beyond 1.8%, the carbide becomes coarse, and hence rolling contact fatigue properties and a cutting property are deteriorated. The lower limit of the content of Cr is preferably 1.4% or more (more preferably 1.5% or more), and the upper limit thereof is preferably up to 1.7% (more preferably up to 1.6%).

[P: Up to 0.05% (Exclusive of 0)]

P is an impurity element that segregates in a crystal grain boundary and adversely affects rolling contact fatigue properties. In particular, if the content of P is more than 0.05%, rolling contact fatigue properties are remarkably deteriorated. Accordingly, it is needed to suppress the content of P to be up to 0.05%. The content thereof is preferably up to 0.03%, and more preferably up to 0.02%. Herein, P is an impurity that is unavoidably comprised in steel material, and it is industrially difficult to make the amount thereof to be 0%.

[S: Up to 0.01% (Exclusive of 0)]

S is an element that forms a sulfide, and if the content thereof is more than 0.01%, a coarse sulfide remains, and hence rolling contact fatigue properties are deteriorated. Accordingly, it is needed to suppress the content of S to be up to 0.01%. From the viewpoint of improving rolling contact fatigue properties, a lower content of S is more suitable, and the content thereof is preferably up to 0.007%, and more preferably up to 0.005%. Herein, S is an impurity that is unavoidably comprised in steel material, and it is industrially difficult to make the amount thereof to be 0%.

[Al: 0.0002 to 0.005%]

Al is an unwanted element, and it is needed to make the amount thereof to be as small as possible in the steel material according to the present invention. Accordingly, a deoxidation treatment by the addition of Al is not performed after oxidation refining. If the content of Al is high, in particular, more than 0.005%, hard oxides, which are mainly formed by $Al_2O_3$, are generated in a large amount, and they remain even after rolling as coarse oxides, and hence rolling contact fatigue properties are deteriorated. Accordingly, the content of Al is made to be up to 0.005%. The content of Al is preferably up to 0.004%, and more preferably up to 0.003%. However, if the content thereof is made to be less than 0.0002%, the content of $Al_2O_3$ is too low in the oxide-inclusions, and hence the deformation resistance of the inclusion is increased and a fining effect cannot be obtained. Accordingly, the lower limit of the content of Al is made to be 0.0002% or more (preferably 0.0005% or more).

[Ca: 0.0002 to 0.0010%]

Ca functions so as to; control inclusions in steel material; make the inclusions to easily extend during hot working; and make the inclusions to be easily broken down and fined during cold working, and hence Ca is effective for improving rolling contact fatigue properties. In order to exert such an effect, it is needed to make the content of Ca to be 0.0002% or more. However, if the content thereof is excessive beyond 0.0010%, the ratio of CaO becomes too large in an oxide chemical composition, thereby causing a coarse oxide. Accordingly, the content of Ca is made to be up to 0.0010%. The lower limit of the content of Ca is preferably 0.0003% or more (more preferably 0.0005% or more), and the upper limit thereof is preferably up to 0.0009% (more preferably up to 0.0008%). Herein, Ca is typically inputted, as an alloy element, in the final stage during a melting step.

[O: Up to 0.0030% (Exclusive of 0)]

O is an unwanted impurity element. If the content of O is high, in particular, more than 0.0030%, many coarse oxide-inclusions remain after being rolled, and hence rolling contact fatigue properties are deteriorated. Accordingly, it is needed to make the content of O to be up to 0.0030%. The upper limit thereof is preferably up to 0.0024% (more preferably up to 0.0020%).

Contained elements specified in the present invention are as described above, and the balance is iron and unavoidable impurities, and elements (e.g., As, H, N, etc.), which can be brought into depending on the situations of raw materials, materials, and manufacturing facilities, etc., may be allowed to be mixed in as the unavoidable impurities.

In order to control steel material so as to have the aforementioned oxide-inclusion chemical composition, it is needed to follow the procedures described below. At first, in melting steel material, deoxidation by the addition of Si is performed, not a deoxidation treatment by the addition of Al that is typically performed. In order to control the compositions of CaO, $Al_2O_3$, and MnO in the melting, the contents of Al, Ca, and Mn, which are comprised in the steel, are controlled so as to be 0.0002 to 0.005%, 0.0002 to 0.0010%, and 0.10 to 1.0%, respectively. The content of MgO can be controlled by using refractories comprising MgO as a melting furnace, refining vessel, and carrying vessel in the melting and by controlling a melting period of time after the input of an alloy so as to be 5 to 30 minutes. Further, the composition of $SiO_2$ can be obtained by controlling other oxide chemical compositions as described above.

In order to make a maximum major axis diameter of oxide inclusions in the longitudinal section to be 20 μm or less, the steel material whose chemical composition has been controlled as described above is subjected to rolling and spheroidizing annealing and then subjected to cold working at a working ratio of 5% or more, thereby allowing spheroidal cementite steel material in which the maximum major axis diameter is reduced by the inclusions being divided to be obtained.

The aforementioned cold working is performed to make the maximum major axis diameter to be 20 μm or less by dividing the inclusions; however, for the achievement of the purpose, it is needed to make at least a cold working ratio to be 5% or more. The upper limit of the cold working ratio is not particularly limited, but it is typically made to be approximately 50%. The aforementioned "cold working ratio" is a value (surface reduction rate: RA) represented by the following equation (1):

$$\text{Cold Working Ratio}=\{(S_0-S_1)/S_0\}\times 100(\%) \quad (1)$$

where $S_0$ is a section area of steel material before being subjected to the working and $S_1$ is a section area of the steel material after being subjected to the working.

It is sufficient that the manufacturing conditions other than those described above (e.g., conditions of hot rolling and spheroidizing annealing, etc.) are made to be general conditions (see later-described Examples).

After being formed into a predetermined part shape, the bearing steel material according to the present invention is subjected to quenching and tempering to be made into a bearing part, but the shape of the steel material may be a linear or rod shape from which the aforementioned part shape can be manufactured and the size of the steel material can be appropriately determined in accordance with a final product.

Hereinafter, the present invention will be described in more detail with reference to Examples, but the invention should not be limited by the following Examples, and the invention can also be practiced by adding modifications within a range in which each of the modifications comports with the aforementioned and later-described sprit, which can be encompassed by the scope of the invention.

EXAMPLES

Each of steel materials (steel types) having the respective chemical compositions shown in Table 1 was melted in a small melting furnace (150 kg/1 ch) by subjecting to a deoxidation treatment by the addition of Si, not a deoxidation treatment by the addition of Al that is typically performed (however, the steel type 11 is subjected to a deoxidation treatment by the addition of Al), thereby allowing a metal slab having a size of ϕ 245 mm×480 mm to be manufactured. In this case, the content of MgO was adjusted by using refractories comprising MgO as a melting furnace, refining vessel, and carrying vessel. In addition, a melting period of time after the input of the melted steel was controlled (Table 1), and the contents of Al, Ca, and Mn, which are comprised in the steel, were controlled as shown in Table 1. The oxide-inclusion chemical composition in each steel material is also shown in Table 1 (measuring method will be described later).

TABLE 1

| Steel Material | Chemical Composition* (% by mass) of Steel Material | | | | | | | | | Chemical Composition of Oxide-inclusions** (% by mass) | | | | | Melting Period of Time |
|---|---|---|---|---|---|---|---|---|---|---|---|---|---|---|---|
| No. | C | Si | Mn | Cr | P | S | Al | Ca | O | CaO | $Al_2O_3$ | $SiO_2$ | MnO | MgO | (min) |
| 1 | 0.95 | 0.25 | 0.34 | 1.43 | 0.013 | 0.005 | 0.0006 | 0.0007 | 0.0017 | 24.4 | 27.7 | 38.0 | 6.6 | 3.3 | 5 |
| 2 | 1.02 | 0.25 | 0.27 | 1.55 | 0.014 | 0.006 | 0.0007 | 0.0007 | 0.0016 | 22.1 | 31.6 | 35.0 | 1.9 | 9.3 | 30 |
| 3 | 0.86 | 0.16 | 0.44 | 1.30 | 0.018 | 0.005 | 0.0015 | 0.0003 | 0.0019 | 14.0 | 39.5 | 30.2 | 11.1 | 5.2 | 10 |
| 4 | 1.00 | 0.76 | 0.33 | 1.45 | 0.010 | 0.009 | 0.0005 | 0.0007 | 0.0017 | 25.8 | 21.9 | 44.4 | 2.5 | 5.4 | 10 |
| 5 | 1.01 | 0.19 | 0.40 | 1.39 | 0.011 | 0.006 | 0.0005 | 0.0008 | 0.001 | 30.9 | 25.2 | 34.8 | 4.7 | 4.3 | 8 |

TABLE 1-continued

| Steel Material | Chemical Composition* (% by mass) of Steel Material | | | | | | | | | Chemical Composition of Oxide-inclusions** (% by mass) | | | | | Melting Period of Time |
|---|---|---|---|---|---|---|---|---|---|---|---|---|---|---|---|
| No. | C | Si | Mn | Cr | P | S | Al | Ca | O | CaO | $Al_2O_3$ | $SiO_2$ | MnO | MgO | (min) |
| 6 | 0.96 | 0.25 | 1.28 | 1.48 | 0.014 | 0.009 | 0.0005 | 0.0006 | 0.0026 | 23.9 | 24.0 | 31.7 | 17.6 | 2.8 | 2 |
| 7 | 0.99 | 0.26 | 0.34 | 1.44 | 0.013 | 0.007 | 0.0005 | 0.0005 | 0.0012 | 29.1 | 21.2 | 37.9 | 0.7 | 11.1 | 35 |
| 8 | 0.99 | 0.25 | 0.33 | 1.46 | 0.014 | 0.007 | 0.0055 | 0.0005 | 0.0014 | 17.5 | 46.1 | 30.3 | 1.1 | 4.9 | 10 |
| 9 | 0.99 | 0.28 | 0.38 | 1.44 | 0.010 | 0.010 | 0.0005 | 0.0001 | 0.0024 | 3.2 | 21.0 | 55.8 | 10.9 | 9.1 | 30 |
| 10 | 1.01 | 0.36 | 0.17 | 1.41 | 0.006 | 0.004 | 0.0001 | 0.0009 | 0.0022 | 40.6 | 10.8 | 38.8 | 0.8 | 9.0 | 30 |
| 11 | 0.97 | 0.20 | 0.47 | 1.50 | 0.012 | 0.005 | 0.0210 | — | 0.0007 | — | 87.7 | — | 2.7 | 9.6 | 30 |
| 12 | 0.99 | 0.24 | 0.35 | 1.44 | 0.014 | 0.006 | 0.0006 | 0.0014 | 0.0014 | 45.9 | 20.1 | 30.3 | 0.5 | 3.2 | 5 |
| 13 | 0.96 | 0.35 | 0.37 | 1.40 | 0.012 | 0.019 | 0.0005 | 0.0006 | 0.0018 | 22.8 | 24.5 | 38.2 | 5.6 | 8.9 | 30 |
| 14 | 1.01 | 0.12 | 0.08 | 1.45 | 0.062 | 0.005 | 0.0005 | 0.0008 | 0.0014 | 28.9 | 32.7 | 32.3 | 0.4 | 5.7 | 15 |
| 15 | 1.09 | 0.70 | 0.22 | 0.98 | 0.012 | 0.005 | 0.0005 | 0.0007 | 0.0017 | 28.3 | 20.6 | 43.3 | 3.7 | 4.1 | 10 |
| 16 | 1.22 | 0.28 | 0.36 | 1.92 | 0.012 | 0.004 | 0.0006 | 0.0007 | 0.0017 | 26.9 | 26.5 | 36.7 | 5.2 | 4.7 | 10 |
| 17 | 0.62 | 0.30 | 0.28 | 1.45 | 0.014 | 0.006 | 0.0007 | 0.0007 | 0.0016 | 24.6 | 30.4 | 33.7 | 3.4 | 7.9 | 20 |
| 18 | 1.08 | 0.30 | 0.79 | 1.72 | 0.013 | 0.005 | 0.0005 | 0.0009 | 0.0023 | 33.4 | 20.2 | 30.5 | 12.8 | 3.1 | 5 |
| 19 | 0.99 | 0.26 | 0.34 | 1.40 | 0.013 | 0.005 | 0.0007 | 0.0007 | 0.0014 | 27.0 | 29.5 | 30.6 | 12.1 | 0.8 | 1 |
| 20 | 1.03 | 0.22 | 1.35 | 1.42 | 0.012 | 0.005 | 0.0004 | 0.0004 | 0.0024 | 19.5 | 22.2 | 35.3 | 19.3 | 3.7 | 5 |
| 21 | 1.01 | 0.21 | 0.85 | 1.43 | 0.014 | 0.004 | 0.0004 | 0.0006 | 0.0031 | 25.6 | 20.3 | 30.5 | 14.4 | 9.2 | 30 |

*Balance: Unavoidable Impurities Other Than Iron, P, S, and O

**When total <100%, balance is unavoidable impurities.

After being heated to 1100 to 1300° C. in a heating furnace, the obtained metal slab was subjected to blooming at 900 to 1200° C. Thereafter, the metal slab was rolled at 830 to 1100° C., i.e., was subjected to hot rolling or hot forging so as to have a predetermined diameter (ϕ20 mm).

After the hot rolled steel material or hot forged steel material was heated in a temperature range of 760 to 800° C. for 2 to 8 hours, it was cooled to a temperature (Ar1 transformation point −60° C.) at a cooling rate of 10 to 15° C./h and then cooled in the atmosphere (spheroidizing annealing), thereby allowing spheroidized annealed steel material in which spheroidal cementites are dispersed to be obtained.

The aforementioned spheroidized annealed steel materials were subjected to cold working at various working ratios to make wire rods (ϕ 15.5 to 20.0 mm: wire diameter after the cold working). Thereafter, a specimen having a size of ϕ 12 mm×length 22 mm was cut out, which was heated at 840° C. for 30 minutes and then subjected to oil-quenching followed by tempering at 160° C. for 120 minutes. Subsequently, final polishing was performed on the specimen such that a radial rolling contact fatigue test specimen having a surface roughness of 0.04 μm Ra or less was produced.

The oxide-inclusion chemical composition (average chemical composition) and the maximum major axis diameter of oxide-inclusions in the longitudinal section in each of the aforementioned test specimens were measured in accordance with the following methods, respectively.

[Measurement of Average Chemical Composition of Oxide-Inclusions]

Ten micro samples each having a size of 20 mm (length in the rolling direction)×5 mm (depth from the surface layer), which were to be used for structure observation, were cut out in the longitudinal direction (which corresponds to the rolling direction) of each specimen at the position located half the diameter D thereof, and the sections of the samples were polished. The chemical compositions of arbitrary oxide-inclusions each having a minor axis of 1 μm or more, which were located within an area (polished surface) of 100 $mm^2$, were analyzed by an EPMA, the results of which were converted into the contents of oxides. In this case, the conditions of the measurement by the EPMA were as follows.

(Conditions of Measurement by EPMA)

EPMA apparatus: Product name "JXA-8500F" made by JEOL Ltd.

EDS analysis: NORAN System Six made by Thermo Fisher Scientific K.K.

Accelerating voltage: 15 kV

Scanning current: 1.7 nA

[Measurement of Maximum Major Axis Diameter of Oxide-Inclusions]

Ten micro samples each having a size of 20 mm (length in the rolling direction)×5 mm (depth from the surface layer), which were to be used for structure observation, were cut out in the longitudinal direction (which corresponds to the rolling direction) of each specimen at the position located half the diameter D thereof, and the sections of the samples were polished. A maximum major axis diameter of oxide-inclusions in the polished surface of each sample (100 $mm^2$) was measured by an optical microscope, and the largest major axis diameter within 1000 $mm^2$ is made to be a maximum major axis diameter. Herein, when the measurement area is small, a predicted maximum major axis diameter per 1000 $mm^2$ may be determined by an extremal value statistics method.

A radial rolling contact fatigue test was performed by using the radial rolling contact fatigue test specimen thus obtained and a radial rolling contact fatigue testing machine (product name "Point-Contact-Type Life Test Machine" made by NTN Corporation) under the conditions in which repeating speed was 46485 cpm, contact pressure was 5.88 GP, and the number of cycles when the test was to be terminated was 300 million cycles ($3\times10^8$ cycles). In this case, 15 test specimens were tested per each steel material to evaluate a fatigue life $L_{10}$ (number of repeated stress cycles to failure at a cumulative failure probability of 10%: hereinafter, sometimes referred to as "$L_{10}$ life"); and steel material was evaluated to be excellent in the rolling contact fatigue life, in which all $L_{10}$ lives were 30 million cycles ($3\times10^7$ cycles) or more (i.e., no peeling occurred at the number of cycles less than $3\times10^7$ cycles) and the ratio (life ratio) of the $L_{10}$ life thereof to that (Test No. 6) of conventional steel (steel No. 11) was 2.5 or more ($L_{10}$ life corresponded to the number of cycles more than or equal to 27.50 million cycles).

Results of these measurements [results of evaluating radial rolling contact fatigue tests ($L_{10}$ lives, life ratios, the number of pieces of peeling occurring at the number of cycles less than $3\times10^7$ cycles), maximum major axis diameter of oxide-inclusions] are shown in Table 2, along with cold working ratios during working and wire diameters after the cold working.

TABLE 2

Result of Evaluation of Rolling Contact Fatigue Test

| Test No. | Steel Type | $L_{10}$ Life ($\times 10^7$ Cycles) | Life Ratio | Number of Pieces of Peeling Occurring at Less Than $3 \times 10^7$ Cycles | Maximum Major Axis Diameter of Oxide-inclusions (μm) | Cold Working Ratio (%) | Wire Diameter After Cold Working (mm) |
|---|---|---|---|---|---|---|---|
| 1 | 1 | 1.5 | 1.3 | 2 | 26.0 | 0.0 | 20.0 |
| 2 | | 2.5 | 2.1 | 1 | 22.2 | 2.0 | 19.8 |
| 3 | | 5.3 | 4.4 | 0 | 19.5 | 5.9 | 19.4 |
| 4 | | 8.0 | 6.7 | 0 | 13.5 | 19.0 | 18.0 |
| 5 | | 11.1 | 9.3 | 0 | 8.8 | 39.9 | 15.5 |
| 6 | 11 | 1.2 | 1.0 | 4 | 13.5 | 0.0 | 20.0 |
| 7 | | 2.5 | 2.1 | 1 | 12.6 | 39.9 | 15.5 |
| 8 | 8 | 1.1 | 0.9 | 4 | 23.4 | 0.0 | 20.0 |
| 9 | | 1.9 | 1.6 | 2 | 21.5 | 39.9 | 15.5 |
| 10 | 3 | 2.3 | 1.9 | 2 | 24.7 | 0.0 | 20.0 |
| 11 | | 2.8 | 2.3 | 1 | 22.1 | 2.0 | 19.8 |
| 12 | | 3.2 | 2.7 | 0 | 17.8 | 5.9 | 19.4 |
| 13 | | 3.9 | 3.3 | 0 | 14.7 | 19.0 | 18.0 |
| 14 | | 5.6 | 4.7 | 0 | 11.2 | 39.9 | 15.5 |
| 15 | 4 | 2.1 | 1.8 | 3 | 28.5 | 0.0 | 20.0 |
| 16 | | 2.7 | 2.3 | 2 | 24.6 | 2.0 | 19.8 |
| 17 | | 3.8 | 3.2 | 0 | 19.2 | 5.9 | 19.4 |
| 18 | | 4.2 | 3.5 | 0 | 16.0 | 19.0 | 18.0 |
| 19 | | 4.9 | 4.1 | 0 | 14.6 | 39.9 | 15.5 |
| 20 | 2 | 3.6 | 3.0 | 0 | 16.3 | 39.9 | 15.5 |
| 21 | 5 | 4.2 | 3.5 | 0 | 14.9 | 39.9 | 15.5 |
| 22 | 9 | 2.7 | 2.3 | 5 | 33.5 | 0.0 | 20.0 |
| 23 | | 2.9 | 2.4 | 2 | 32.5 | 39.9 | 15.5 |
| 24 | 8 | 2.0 | 1.7 | 1 | 23.4 | 39.9 | 15.5 |
| 25 | 10 | 1.1 | 0.9 | 4 | 30.1 | 0.0 | 20.0 |
| 26 | 6 | 1.8 | 1.5 | 3 | 28.6 | 39.9 | 15.5 |
| 27 | | 1.0 | 0.8 | 4 | 25.0 | 39.9 | 15.5 |
| 28 | 7 | 1.4 | 1.2 | 2 | 24.7 | 39.9 | 15.5 |
| 29 | 18 | 3.8 | 3.2 | 0 | 17.4 | 39.9 | 15.5 |
| 30 | 12 | 1.3 | 1.1 | 2 | 28.2 | 39.9 | 15.5 |
| 31 | 13 | 1.1 | 0.9 | 4 | 15.4 | 39.9 | 15.5 |
| 32 | 14 | 1.2 | 1.0 | 2 | 16.0 | 39.9 | 15.5 |
| 33 | 15 | 1.3 | 1.1 | 1 | 14.4 | 39.9 | 15.5 |
| 34 | 16 | 1.1 | 0.9 | 1 | 16.1 | 39.9 | 15.5 |
| 35 | 17 | 1.4 | 1.2 | 1 | 15.8 | 39.9 | 15.5 |
| 36 | 19 | 1.2 | 1.0 | 1 | 23.2 | 39.9 | 15.5 |
| 37 | 20 | 1.1 | 0.4 | 1 | 24.5 | 39.9 | 15.5 |
| 38 | 21 | 1.0 | 0.4 | 1 | 26.3 | 39.9 | 15.5 |

From these results, it can be considered as follows. That is, it can be known that Test Nos. 3 to 5, 12 to 14, 17 to 21, and 29 satisfy the requirements for chemical compositions (chemical composition of steel material and oxide-inclusion chemical composition) and a maximum major axis diameter of oxide-inclusions, which are both specified in the present invention, and they are all excellent in rolling contact fatigue lives.

On the other hand, it can be known that each of Test Nos. 1, 2, 6 to 11, 15, 16, 22 to 28, and 30 to 38 represents an example in which either of the requirements specified in the present invention is not satisfied, and an excellent rolling contact fatigue life is not obtained.

Among them, in each of Test Nos. 1, 2, 10, 11, 15, and 16, the maximum major axis diameter of oxide-inclusions is large because the cold working ratio is small (the chemical composition is within the range specified in the present invention), and the rolling contact fatigue properties are deteriorated.

Each of Test Nos. 6 and 7 represents an example in which a steel type obtained by an Al deoxidation treatment (steel type No. 11: conventional aluminum-killed steel) is used, and the content of $Al_2O_3$ is high in the oxide-inclusions because the content of Al is excessive, and the rolling contact fatigue properties are deteriorated.

Each of Test Nos. 8, 9, and 24 represents an example in which a steel type having an excessive content of Al (steel type No. 8) is used, and the content of $Al_2O_3$ is high in the oxide-inclusions and the maximum major axis diameter of oxide-inclusions is also large, and the rolling contact fatigue properties are deteriorated.

Each of Test Nos. 22 and 23 represents an example in which a steel type having an insufficient content of Ca (steel type No. 9) is used, and the content of CaO is low in the oxide-inclusions, the content of $SiO_2$ is high, and the maximum major axis diameter of oxide-inclusions is also large, and the rolling contact fatigue properties are deteriorated.

Test No. 25 represents an example in which a steel type having an insufficient content of Al (steel type No. 10) is used, and the content of $Al_2O_3$ is low in the oxide-inclusions and the maximum major axis diameter of oxide-inclusions is also large, and the rolling contact fatigue properties are deteriorated.

Each of Test Nos. 26 and 27 represents an example in which a steel type having an excessive content of Mn (steel type No. 6) is used and the steel type has been subjected to a treatment in which a melting period of time is as short as 2 minutes, and the content of MgO is high in the oxide-inclusions, the content of MgO is low, and the maximum major axis diameter of oxide-inclusions is large, and the rolling contact fatigue properties are deteriorated.

Test No. 28 represents an example in which the steel has been subjected to a treatment in which a melting period of time is as long as 35 minutes, the content of MgO is high in the oxide-inclusions because the MgO comprised in refractories is mixed in, and the maximum major axis diameter of oxide-inclusions is also large, and the rolling contact fatigue properties are deteriorated. Test No. 30 represents an example in which a steel type having an excessive content of Ca (steel type No. 12) is used, and the content of CaO is high in the oxide-inclusions and the maximum major axis diameter of oxide-inclusions is also large, and the rolling contact fatigue properties are deteriorated.

Test No. 31 represent an example in which a steel type having an excessive content of S (steel type No. 13) is used, and it is expected that a generation amount of MnS may be increased, and the rolling contact fatigue properties are deteriorated. Test No. 32 represents an example in which a steel type having contents of Si, Mn, and P that are outside the range specified in the present invention (steel type No. 14) is used, and it is expected that the strength may be decreased, and the rolling contact fatigue properties are deteriorated.

Test No. 33 represents an example in which a steel type having an insufficient content of Cr (steel type No. 15) is used, and it is expected that a desired spheroidal structure cannot be obtained, and the rolling contact fatigue properties are deteriorated. Test No. 34 represents an example in which a steel type having excessive contents of C and Cr (steel type No. 16) is used, and it is expected that a huge carbide may be generated, and the rolling contact fatigue properties are deteriorated.

Test No. 35 represents an example in which a steel type having an insufficient content of C (steel type No. 17) is used, and it is expected that a desired spheroidal structure cannot be obtained, and the rolling contact fatigue properties are deteriorated. Test No. 36 represents an example in which the steel type has been subjected to a treatment in which a melting period of time is as short as 1 minute, the content of MgO is low in the oxide-inclusions, and the maximum major axis diameter of oxide-inclusions is also large, and the rolling contact fatigue properties are deteriorated.

Test No. 37 represents an example in which a steel type having an excessive content of Mn (steel type No. 20) is used and the content of MnO is high in the oxide-inclusions and the maximum major axis diameter of oxide-inclusions is also large, and the rolling contact fatigue properties are deteriorated. Test No. 38 represents an example in which a steel type having an excessive content of O (steel type No. 21) is used, and it is expected that the oxide-inclusions may be coarse, and the rolling contact fatigue properties are deteriorated.

Figure 2:
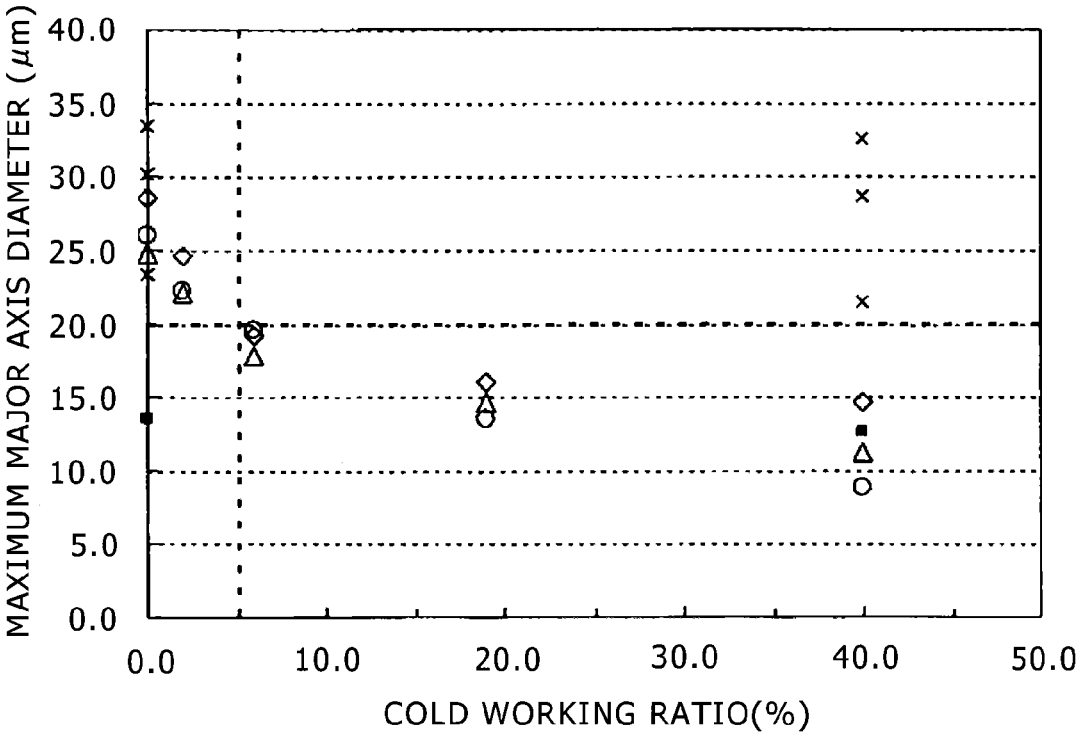
FIG. 2 is a graph showing the relationship between a cold working ratio and the maximum major axis diameter of oxide-inclusions.

Based on these data, the relationship between the maximum major axis diameter of oxide-inclusions (simply denoted as "Maximum Major Axis Diameter") and the $L_{10}$ life is shown in FIG. 1, and that between the cold working ratio (%) and the maximum major axis diameter is shown in FIG. 2. In FIG. 1, "circle symbols", "filled square symbols", and "xx" are plotted, respectively, where the circle symbol represents each of the examples of the present invention (Test Nos. 3 to 5, 12 to 14, 17 to 21, and 29), the filled square symbol represents each of the examples of conventional technologies (Test Nos. 6 and 7), the x represents each of the comparative examples (Test Nos. 1, 2, 8 to 11, 15, 16, 22 to 28, 30, 33, and 36 to 38) in which steel types (steel types 1 to 5, 7 to 10, 12, 15, 19, and 21) whose contents of C, Si, Cr, P, and S satisfy the ranges specified in the invention are used, but other requirements are not satisfied.

In FIG. 2, "circle symbols", "triangle symbols", "diamond symbols", and "filled square symbols" are plotted, respectively, where the circle symbol represents each of the examples (Test Nos. 1 to 5) in which the steel type 1 is used, the triangle symbol represents each of the examples (Test Nos. 10 to 14) in which the steel type 3 is used, the diamond symbol represents each of the examples (Test Nos. 15 to 19) in which the steel type 4 is used, the filled square symbol represents each of the examples of conventional technologies (Test Nos. 6 and 7), and the x represents each of the comparative examples (Test Nos. 8, 9, 22, 23, 25, and 26).

From the results of FIG. 1, it is known that good rolling contact fatigue properties ($L_{10}$ life) can be exerted by making the maximum major axis diameter to be 20 μm or less. From the results of FIG. 2, it is known that the maximum major axis diameter can be controlled so as to be 20 μm or less by making a cold working ratio to be 5% or more.

The invention claimed is:

1. A bearing steel material, comprising:

by mass%, from 0.8% to 1.1% of C;

from 0.15% to 0.8% of Si;

from 0.10% to 1.0% of Mn;

up to 0.05%, excluding 0%, of P;

up to 0.01%, excluding 0%, of S;

from 1.3% to 1.8% of Cr;

from 0.0002% to 0.005% of Al;

from 0.0002% to 0.0010% of Ca;

up to 0.0030%, excluding 0%, of O; and iron, wherein an average chemical composition of oxide-inclusions in the bearing steel material is, by mass%: from 10% to 45% of CaO; from 20% to 45% of $Al_2O_3$; from 30% to 50% of $SiO_2$; up to 15%, excluding 0%, of MnO; and from 3% to 10% of MgO;

a maximum major axis diameter of the oxide-inclusions in a longitudinal section of the bearing steel material is 20 μm or less; and the bearing steel material has a spheroidal cementite structure.

2. The bearing steel material according to claim 1, wherein the bearing steel material is obtained by being subjected to cold working at a working ratio of 5% or more after spheroidizing annealing.

3. The bearing steel material according to claim 1, wherein the maximum major axis diameter of the oxide-inclusions in the longitudinal section of the bearing steel material is 18 μm or less.

4. The bearing steel material according to claim 1, wherein the maximum major axis diameter of the oxide-inclusions in the longitudinal section of the bearing steel material is 16 μm or less.

5. The bearing steel material according to claim 1, which comprises from 0.0007 to 0.0010 mass% of Ca.

6. A bearing part, comprising:

the bearing steel material according to claim 1.

7. A bearing part, comprising:

The bearing steel material according to claim 2.

* * * * *